United States Patent [19]

Monteyne et al.

[11] Patent Number: 4,494,971

[45] Date of Patent: Jan. 22, 1985

[54] PROCESS AND APPARATUS FOR GRANULATION OF SLAG

[75] Inventors: Guido Monteyne, Lembeke, Belgium; Marc Calmes, Luxembourg; Robert Schmeler, Dalheim, both of Luxembourg

[73] Assignee: Paul Wurth S.A., Luxembourg, Luxembourg

[21] Appl. No.: 442,456

[22] Filed: Nov. 17, 1982

[30] Foreign Application Priority Data

Nov. 18, 1981 [LU] Luxembourg ..... 83768

[51] Int. Cl.[3] ..... C03B 19/08

[52] U.S. Cl. ..... 65/19; 65/29; 65/141; 65/161; 65/164; 75/24

[58] Field of Search ..... 65/19, 20, 29, 141, 65/161, 164; 75/24

[56] References Cited

U.S. PATENT DOCUMENTS

| | | | |
|---|---|---|---|
| 3,594,142 | 7/1971 | Margesson et al. | 65/19 |
| 4,171,965 | 10/1979 | Schockmel | 65/20 X |
| 4,374,645 | 2/1983 | Monteyne | 23/293 A |

FOREIGN PATENT DOCUMENTS

| | | | |
|---|---|---|---|
| 53-86699 | 7/1978 | Japan . | |
| 359406 | 10/1930 | United Kingdom | 65/141 |
| 676574 | 7/1979 | U.S.S.R. | 65/19 |

*Primary Examiner*—Robert Lindsay
*Attorney, Agent, or Firm*—Fishman & Dionne

[57] ABSTRACT

A method and apparatus are presented for granulation of molten slag for determining the flow of molten slag and adjusting the supply of granulation water in accordance with the flow of molten slag.

25 Claims, 10 Drawing Figures

FIG. 3
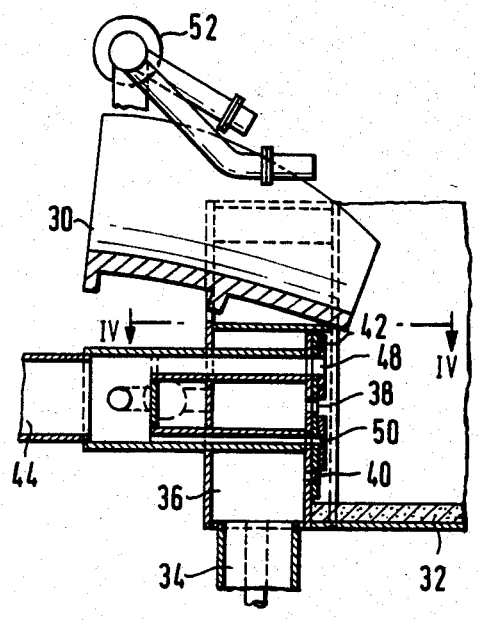
FIG. 5
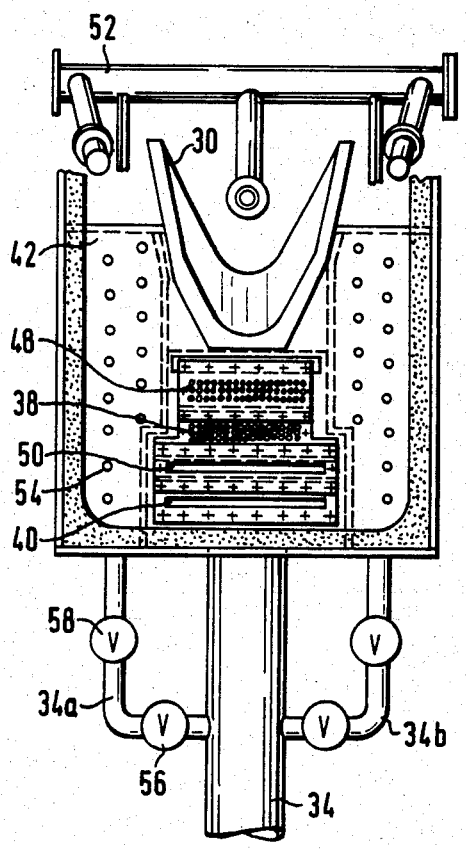
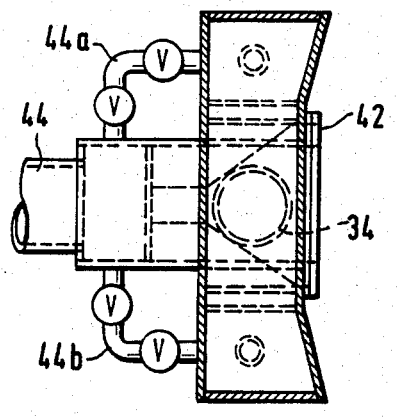
FIG. 4

PROCESS AND APPARATUS FOR GRANULATION OF SLAG

BACKGROUND OF THE INVENTION

The present invention relates to apparatus and a process for the liquid granulation of slag. More particularly, this invention relates to the granulation of blast furnace slag, in which the slag in a molten state is caused to drop into a granulation enclosure into which water is injected under pressure in the form of a number of superimposed currents and from which the slurry consisting of granulated slag and water is evacuated to apparatus for filtration and separation of the water from the granulated slag. The filtration and separation apparatus comprises a rotary filter drum which rotates about a horizontal axis and which is fitted internally with filtration buckets which during the rotation of the drum are immersed in the slurry and carry the granulated slag upwards in order to discharge it onto an evacuation belt.

In the field of slag granulation, as in others, efforts are being made more than ever before to economize in energy and in raw materials. European patent application No. 0043605 and U.S. patent application Ser. No. 267,880, now U.S. Pat. No. 4,374,645 already made it possible to achieve considerable progress in this direction resulting from the fact that it proposes a separation of the two essential functions of the water, i.e., the granulation and the evacuation of the slag, for which purpose it provides that the water is to be injected into the granulation enclosure in the form of two superimposed and independent currents. This design makes it possible, in particular, to keep the two currents at different pressures and temperatures from each other.

However, even if the teachings of the above-identified European patent application enable the consumption of water to be noticeably reduced, the total output nevertheless remains constant and is selected in such a way as to be sufficient for the granulation of a maximum output of slag. However, the output of molten slag from a blast furnace, for example, does not remain constant over a period of time; and the maximum output may reach twice the average value of slag output. Thus, excess water is consumed whenever slag output is less than maximum. Up to the present time, unfortunately, it has not been possible or desirable to adapt the output of granulation water to the output of molten slag, for a number of important reasons.

One important reason is that in most cases, even if the delivery of slag is found to vary, these variations in the slag output cannot be exactly measured.

Another important reason is that if it is desired to modify the volume of water passing through a given orifice, the water pressure has to be modified; and this pressure modification has to be fairly considerable, since the pressure increases in proportion to the square of the volume. This means that if the output is increased, starting from a certain average value, a high increase in the pressure is required, so that the apparent saving of granulation water is more than nullified by the additional energy required for the operation of the pumps. Similarly, if the output is reduced in relation to a certain average, the pressure is no longer sufficient to maintain the granulation process and the evacuation of the slag.

On the other hand, if the rate of flow of granulation water is kept at a value corresponding to an average rate of flow of the slag to be granulated the slag will be insufficiently granulated and cooled when the output of slag is increased. Consequently, in order to ensure adequate granulation and cooling of the slag in all cases, the rate of flow of the current or currents of water in the prior art is selected in such a way that it will be sufficient to enable the slag, even when the output thereof is at its maximum, to be correctly granulated and cooled.

The obvious drawback of the prior art systems is that whenever the output of molten slag is not at its maximum an excessive quantity of granulation water is injected. This means not only waste but a more complicated final filtration, since the water once again has to be separated from the granulated slag if the latter is to be usable. At the same time a waste of energy occurs, since the pumps have to be powered in order to supply volumes of granulation water which would normally not be necessary. These considerations also apply to all the pumps involved in the complete granulation circuit (recirculation, decantation, cooling, etc.).

Since there was heretofore no means of regulating the rate of flow of granulation water in accordance with that of the slag, or the technical complications involved were out of proportion to the savings obtainable, the aforementioned difficulties resulting from the maintenance of the maximum flow of granulation water were reluctantly accepted.

SUMMARY OF THE INVENTION

The present invention provides an improved slag granulation process and apparatus which will enable the aforementioned difficulties to be eliminated or reduced, and which, inter alia, will result in a saving both of the water and of the power consumed.

In accordance with the present invention a slag granulation process and apparatus are presented in which the force required for the rotation of the drum is measured and the weight of granulated slag and the output of molten slag are determined on the basis of this force, the rate of flow of the water being regulated in accordance with the rate of delivery of the molten slag.

While up to the present there were no practicable measuring means capable of providing an accurate and reliable measurement of the output of slag, the present invention enables this information to be obtained without sounding devices or sophisticated measuring instruments, simply by making thorough use of the possibilities offered by a rotary drum filtration installation such as that disclosed in U.S. Pat. No. 4,204,855.

Multiple water currents are employed in the present invention. The rate of water flow is regulated by keeping the flow rate of at least one current of water constant, this constant rate of flow being selected in such a way as to be sufficient for the granulation of the current of molten slag when the slag output is low, while the rate of flow of at least one other current of water varies between zero or a certain minimum and a value such that the sum of the rates of flow of all the currents of water under pressure is sufficient for the granulation of the current of molten slag when the slag output is at its maximum. The rate of flow of the variable current or currents is automatically varied in accordance with the slag flow measurements obtained.

In a first method of operation, regulation of the flow of water is achieved by varying the flow of the upper current of water, i.e., the closest one underneath the falling molten slag, as it is in this position that the performance of this current of water, where the dispersion of the slag is concerned, is at its most efficient.

In a preferred embodiment of the invention three superimposed currents of water under pressure are provided. The uppermost current is variable; the bottommost current is constant; and the middle current can be either constant or adjustable. This embodiment is thus characterized by the fact that the volume output and the pressure of one or more currents are constant while those of one or more other currents are variable.

In an alternative embodiment for the application of the present invention, the pressure of the current with a variable rate of flow is kept constant. In the simplest version of this embodiment a current of water is simply closed or opened, while in another version the rate of flow of a current of water is progressively variable between a minimum and a maximum value.

The present invention also includes apparatus for the application of the process of the invention. The apparatus comprises: means for the production of the currents of water under pressure and for the projection of these currents against the slag falling in an approximately vertical direction from the end of a channel; these currents of water being in the form of a multiplicity of jets generated by the passage of the water through slits and perforations in the front wall of a water supply conduit or chamber fed with water under pressure; a delivery spout for the evacuation of the slag and the water; apparatus for filtration and for separation of water from the granulated slag, this apparatus comprising a rotary filter drum rotating about a horizontal axis and fitten internally with filtration buckets which during the rotation of the drum are immersed in the slurry and carry the granulated slag to the top in order to discharge it onto an evacuation belt; means for measuring the force required for the rotation of the filter drum and producing signals representing the output of molten slag; and means for regulating the rate of flow of the granulation water in accordance with the said signals.

In a first embodiment of the apparatus the water supply chamber or conduit chamber is subdivided into a number of superimposed compartments, separate from one another, the flow of water discharged through the upper chamber being progressively variable between a minimum and a maximum.

In another embodiment the water supply chamber or conduit is subdivided into two independent compartments, each of which communicates with a granulation water feed pipe and in which equal pressure prevail.

In a further embodiment the interior of the water supply conduit or chamber is fitted with a valve having a number of perforations aligned with corresponding performations of the front wall of the chamber. The number of valve perforations is fewer in number than the number of perforations of the front wall of the chamber. The valve is displaceable between an open position giving a maximum rate of flow and a closed position which results in a minimum rate of flow and in which a certain number of perforations in the front wall of the chamber are masked. In order to ensure that the water pressure will remain constant whatever the position of the valve, the operating conditions of the pumps are controlled in accordance with the position of the valve.

In the simplest version use is made of a swivel valve which can be turned back against or moved away from the front wall of the chamber.

In a more complicated version the valve takes the form of a slide valve which enables a certain number of perforations of the front wall to be progressively masked or exposed and the rate of flow thus varied continually between a minimum and a maximum.

Other features and advantages of the present invention will be apparent to and understood by those skilled in the art from the following detailed description and drawings:

BRIEF DESCRIPTION OF THE DRAWINGS

Referring to the drawings, wherein like elements are numbered alike in the several FIGURES:

FIGS. 3 and 4 are a side elevation section and a top plan view, respectively, of a second embodiment of apparatus of the present invention.

FIG. 5 is a front elevation view of the embodiment of FIGS. 3 and 4.

DESCRIPTION OF THE PREFERRED EMBODIMENT

The process of the present invention includes the measuring of the output of slag by means of the rotary drum filter apparatus and the utilization of the result of these measurements for the purpose of regulating the rate of flow of the water. The drum filter apparatus will not be described here in further detail; it is fully disclosed in U.S. Pat. No. 4,204,855, the entire contents of which are incorporated herein by reference and to which reference is made for additional detailed explanation of that apparatus.

It should, however, be noted that regardless of the means by which the drum filter is driven the force required for its rotation can always be measured by means known in the prior art. If, for example, the drum is driven hydraulically, it is sufficient to measure the pressure of the hydraulic fluid, which at any moment provides an indication of the weight of the granulated slag and consequently of the output of the molten slag. It is this pressure reading which according to the present invention is used for the purpose of modifying the rate of flow of granulation water and, in one version of the invention, for the purpose of keeping the ratio between the quantity of water and the quantity of slag constant.

A first method for carrying out the present invention will be described by reference to its application in an installation such as that proposed in the aforementioned European Patent Application No. 0043605. That European patent application proposes a slag granulation installation in a granulation vessel comprising: means for producing a current of water under pressure and projecting this current against the slag falling in a substantially vertical direction from the end of a channel; a discharge spout provided in the path of the current of water and serving to discharge slag and water; the current of water directed against the slag consisting of multiplicity of jets of water produced by the passage of the water through perforations in the front wall of a chamber or conduit fed with water under pressure; the chamber or conduit being subdivided into two parts and comprising upper and lower compartments separated by a longitudinal partition and connected to two separate pipes for water under pressure.

Figure 1:
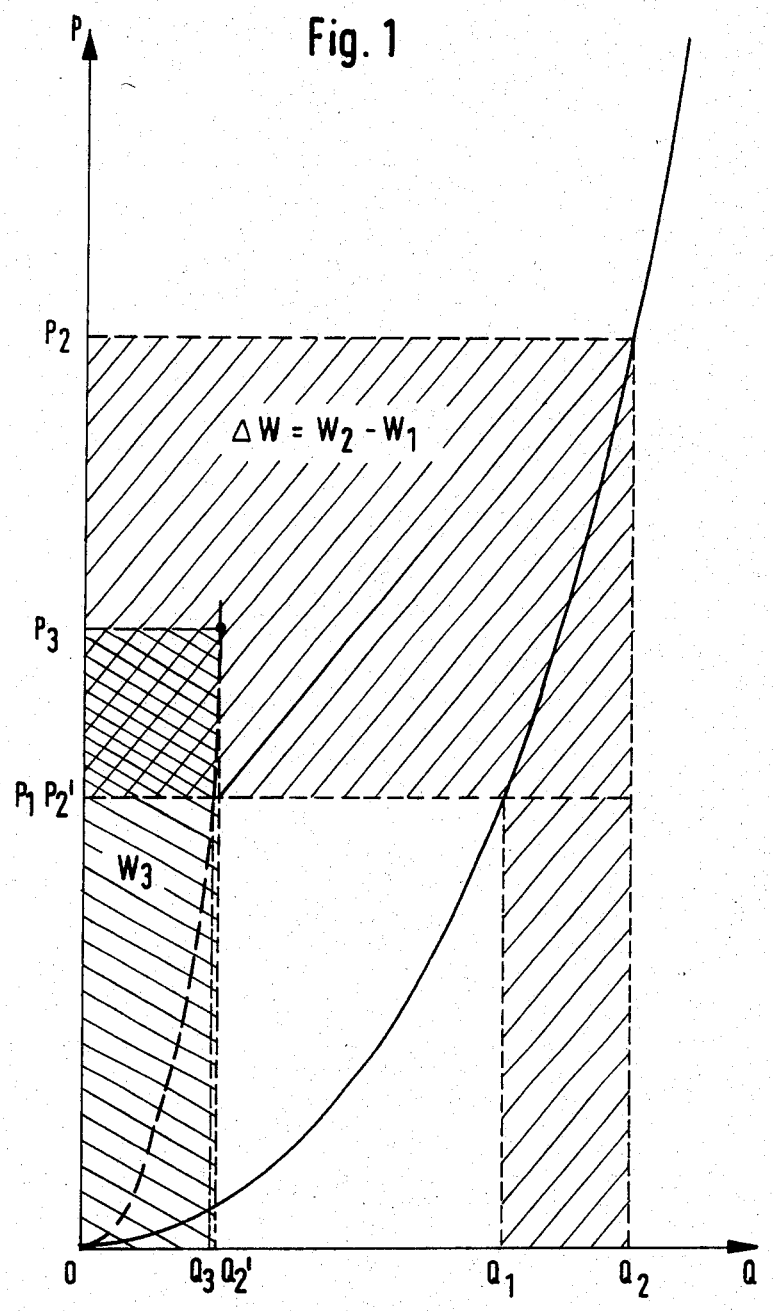
FIG. 1 is a graph showing the relationship between the quantity and the pressure of the granulation water injected into the granulation enclosure.

It is also known from the laws of hydraulics that in a pipe with a laminar flow with a low Reynolds number, the pressure varies in accordance with the square of the velocity of flow. In the case of a turbulent flow the ratio is greater than the square. FIG. 1 represents this relationship. However, instead of expressing the pressure (P) as a function of the velocity the quantity (Q) has been indicated, but this does not change the shape of the curve, since the quantity is directly proportional to the speed.

Referring to FIG. 1 the output of water required for the optimum granulation of the slag, when the output of the slag is low, is indicated at $Q_1$. The pressure corresponding to that rate of flow is indicated at $P_1$. Assuming that it is desired to regulate the rate of flow of the granulation water in accordance with the output of slag and that a rate of flow of $Q_2$ is required for the optimum granulation of the slag when the output of the latter is at its maximum, the pressure of the water would have to be increased from $P_1$ to $P_2$ in order to obtain the rate of flow $Q_2$. As shown by the curve in FIG. 1, this increase is situated in the steep part of the curve and implies a considerable increase in the pressure. This increase in pressure would have to be provided by means of the pumps for the entire quantity of water conveyed, and this involves an uneconomical additional consumption of energy represented by $W=W_2-W_1$, wherein $W_1=k\times P_1\times Q_1$, $W_2=k\times P_2\times Q_2$ and k is constant W is indicated by the hatched area of the graph (sloping downward right to left).

On the other hand, if use is made, in accordance with the present invention, of a separate or supplementary source of water, serving solely for regulating purposes to adjust the total quantity of water to the fluctuations in the output of slag, the separate source would not be operative if an output of water corresponding to $Q_1$ were required. In other words, to enable the additional water $Q_2$ corresponding to the difference between $Q_2$ and $Q_1$ to be injected through the supplementary source, it would only be necessary to increase by $Q'_2$ the output of the supplementary source through another orifice (and thus characterized by another curve) and to increase its pressure to $P'_2$.

This requires an additional amount of energy $W_3$, wherein $$W_3=k\times P'_2\times Q'_2$$

$W_3$ is indicated in FIG. 1 by the hatched area sloping downward from left to right, and it can be seen that $W_3$ is much less than W. The difference between the areas W and $W_3$ proves that saving of energy are obtainable by the process of this invention.

Figure 2:
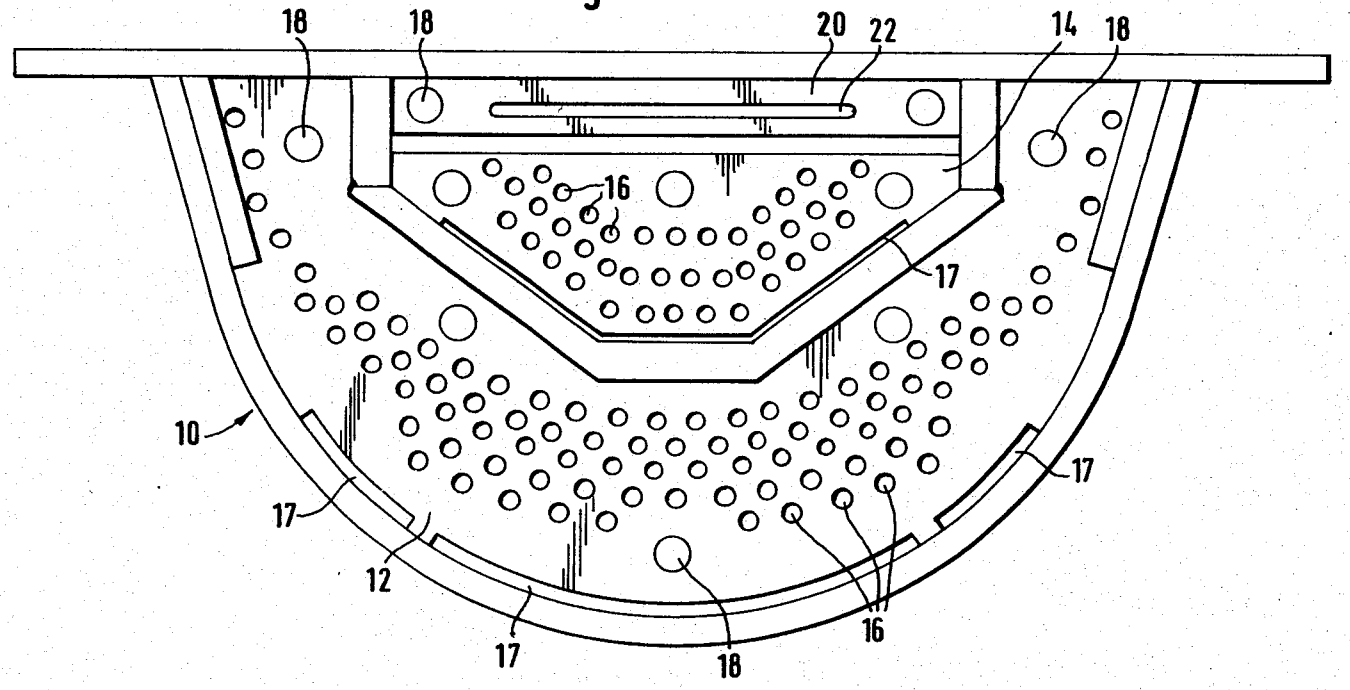
FIG. 2 is a front elevation view of a first version of apparatus of the present invention showing perforated front plates through which different currents of water are injected into the granulation enclosure.

FIG. 2 shows apparatus for practicing the invention. FIG. 2 shows the front wall 10 of a granulation box through which water under pressure is injected against a current of slag as in European patent application No. 0043605. The granulation water is introduced through two separate chambers the fronts of which are closed by plates 12 and 14 respectively to form two water currents. Each of these plates 12 and 14 is provided with a multiplicity of orifices 16 and slits 17 in order to subdivide each of the currents into a multiplicity of jets of water under pressure. Fasteners 18 are removable securing means or securing devices for the plates 12 and 14. The total flow of water injected through the orifices and slits 16 and 17 of the two plates 12 and 14 corresponds to the output $Q_1$ of FIG. 1, i.e., that required for the granulation of the slag when the slag output is low. In accordance with this embodiment of the present invention an additional supply source is provided, consisting of a third chamber behind wall 10, separate from the other two chambers, and closed by means of a front plate 20 having a very narrow transversal slit 22, extending over as much of the width of the current of slag as possible. It is through this slit 22 that the variable supplemental quantity of water under pressure is injected which may vary between an output of zero and the maximum output $Q'_2$ corresponding to the increase $Q_2$-$Q_1$ required in the event of a variation in the output of slag.

Wall 20 and the supplemental supply source should preferably be situated above the other two, i.e., as high up on wall 10 as possible, in order to exert the most satisfactory possible action on the slag. The fact is that the slag must not be allowed to accumulate, under the effect of its own weight, sufficient force to pass through the jets of water without being deflected by them. When, therefore, the upper jet from slit 22 positioned sufficiently high up, the slag will not have accumulated so much force as to avoid being deflected by the said jet. In other words, the jet of this additional source from slit 22 initially deflects the current of slag in the evacuation direction, so that the slag presents itself in a favorable position in relation to the lower currents of water.

One of the important features of front wall 10 is thus the fact that the shape and positioning relationship of the slits and perforations is such that the water passes through with an optimum load loss, in view of the formation of jets completely concentrated in the desired place, i.e., mainly below the trajectory of the current of molten slag and along the walls of the discharge channel.

In the previously mentioned European patent application No. 0043605 the main purpose of the lower current of water (from wall 12) was to evacuate the slag, while the upper current of water (from wall 14) mainly served for the granulation process. As regards the water from the supplementary source (from wall 20) in the present invention, it only participates in the granulation process, doing so in a particularly advantageous manner. The fact is that under the effect of the jet of water from slit 22 from the supplementary source the surrent of slag disintegrates into little particles or balls, which is an ideal consistency for granulation and cooling by the lower currents. The present invention therefore also makes a favorable contribution to the granulation and vitrification process.

As also noted in European patent application No. 0043605 it is possible to influence the consistency and shape of the granulate by varying the temperature of the granulation water. These possibilities are increased by the above-discussed first method for carrying out the present invention, since with the presence of the third current of water, different temperatures can be adopted for the three currents.

It may, however, be of particular advantage, to provide water at the ambient temperature, since this leads to more satisfactory vitrification of the slag. This is of advantage from another point of view, since the lower currents at a constant rate of flow can be limited, to water recycled, for example, at a temperature of about 50°-70° C. The water from the supplementary source would then be water which would be added to the process in order to balance out the water consumption, which normally amounts to about 15-20% of the total quantity of water.

Tests carried out on prototype apparatus have shown that it is possible to granulate an output of slag amounting to 120-360 tons per hour under optimum conditions with a constant rate of flow of less than 1200 $m^3$ per hour for the two lower currents (i.e., through walls 12 and 14). The output of the upper supplementary source through wall 20 varies between zero and 250 $m^3$ per hour, and this constitutes a total consumption of between 1200 and 1450 $m^3$ per hour for the granulation of water. This amounts to a considerable energy saving if it is borne in mind that the greater part of this water is injected at average pressures (i.e., $P_1$) and that, on the other hand, granulation water consumption in prior art granulation installations amounts to about 2000 $m^3$ per hour, with far higher pressures. As regards the saving in energy and resulting saving of pumping costs, as explained with reference to FIG. 1, the saving amounts to 35-50% of the total energy consumed, while granulated slag of optimum quality is simultaneously obtained.

In the case of high performance blast furnaces or when the output of slag fluctuates very considerably, a second supplementary source with an adjustable rate of flow could be employed. This variable second supplemental source would be a fourth current of water. It is also possible to limit the lower current (through wall 12) to one single constant rate of flow and to regulate the delivery passing through the plate 14 and the delivery of water passing through the slit 22, adjusting each of them to between zero or some minimum value and a certain predetermined value required for the granulation of a maximum quantity of slag.

As clearly shown by FIG. 1, a variation in output likewise involves a variation in pressure. In order to optimize the granulation conditions and obtain as uniform a finished product as possible, it may prove desirable not to modify the pressure during the granulation process. As can be seen from the graph in FIG. 1, this objective can be achieved by using a supplemental source which is either fully closed or fully open in $P_1$, rather than being fully adjustable over its range of operation. If it is desired to operate at a constant pressure $P_1$, then either the supplementary source (delivered through wall 20) must be closed (with a rate of flow of zero), with the pressure of the other currents remaining at $P_1$, or the supplementary source must be open, so that the supplemental output is $Q_3$ at the pressure $P_1$.

FIGS. 3-5 illustrate a method for the operation of the invention with a supplementary source which is either opened or closed according to whether the output of molten slag is high or low. In this embodiment the molten slag falls from a channel 30 to a discharge spout 32, the slag being subjected to the action of a number of jets of water in the course of its fall.

A current of water under pressure is pumped through a first feed pipe 34 into a first chamber 36 of which the front plate 42 (see in FIG. 5) is provided with apertures and the outlet slits for the water. In the example illustrated the water is discharged from the chamber 36 via a horizontal slit 40 and a series of perforations 38. The water discharged through the slit 40 serves mainly for the evacuation of the slag in spout 32, while the jets of water formed by the apertures 38 serve essentially for the granulation of the molten slag.

A supplementary source is connected through a second supply pipe 44 which, on a level with the front plate 42, divides into two branches to discharge evacuation water through a slit 50 and granulation water through a series of apertures 48. The pressure in the two feed pipes 33 and 44 is the same, the entire granulation process thus being constantly performed at the same pressure, whether the supplementary source 44 is disconnected, when the output of slag is low, or whether it is in operation, when the output of slag is high.

In view of the fact that the functions of the granulation of the slag and the evacuation of the slurry are separated from each other, due to the provision of the water outlet apertures through the front plate 42, it is possible to provide two separate supply pipes for the main feed 34 and the supplementary feed 44, which enables water at different temperatures and of different origins to be used for the granulation and for the evacuation.

Apart from the evacuation and granulation water, nozzles 52 are used to form, above the granulation enclosure, a sheet of water, the purpose of which is to assist in the condensation of the rising vapors and prevent them from spreading in the casting house.

Furthermore, the front plate 42 is provided with two lateral series of perforations 54 through which rinsing water is injected into the granulation trough. For this purpose both the main pipe 34 and the supplementary supply pipe 34 are connected by means of auxiliary pipes **34*a*, 34*b*, and 44*a*, 44*b*, respectively, to lateral chambers positioned behind the perforations 54 of the front plate 42. Each of these pipes 34*a*, 34*b*, 44*a*, 44*b*, has a value 56 serving to connect or disconnect these lateral chambers, and also a non-return valve 58 serving to prevent the water of the main circuit 34 from becoming mixed with that of the supplementary supply circuit 44** and vice versa.

The graph in FIG. 1 shows the relationship between water volume and pressure for a particular discharge cross section or aperture. For a different aperture this graph will have a different curve, i.e., the curve will be either steeper or flatter. This means that the rate of flow can be modified while maintaining the same pressure by varying or modifying the discharge conditions. This is the principle applied in the embodiment shown in FIGS. 6 and 7, in which valve means varies the flow area.

Figure 6:
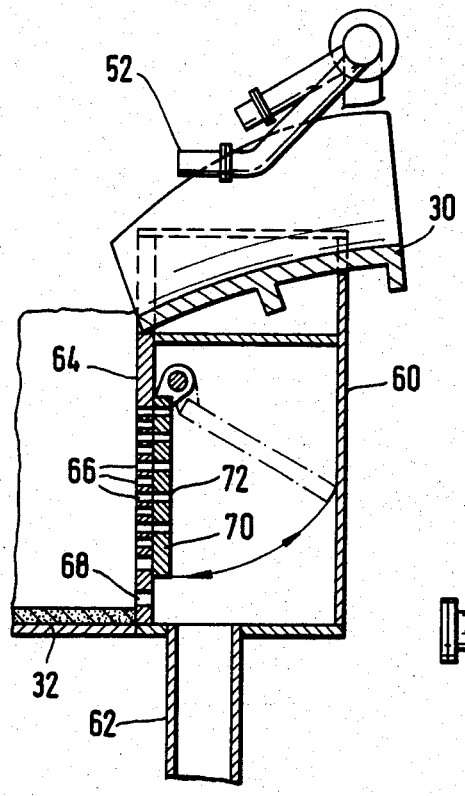
FIG. 6 is a side elevation section of a third embodiment of apparatus of the present invention.
Figure 7:
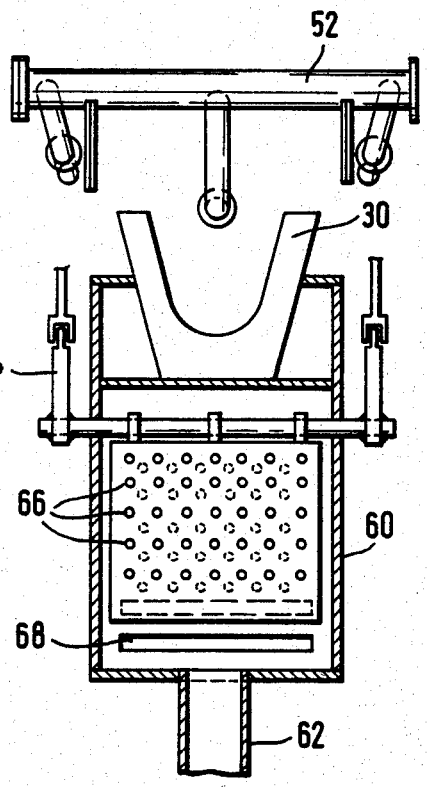
FIG. 7 is a front elevation view partly in section of the third embodiment of FIG. 6.

Referring to the embodiment of FIGS. 6 and 7, water under pressure is pumped through a feed pipe 62 into a chamber 60 of which the front plate 64 is provided with one or more horizontal slits 68 in order to form a jet for the evacuation of slurry and a multiplicity of perforations 66 in order to form jets for the granulation of slag. The special feature of this embodiment is that the chamber 60 contains a swivel valve 70 in the form of a pivotally mounted plate which has a certain number of perforations 72 aligned with the corresponding perforations 66 of the front plate 64. The number of perforations 72 in the plate 70, however, is smaller, e.g., by a half, than the number of perforations 66, so that when the valve 70 is closed, as shown in full lines in FIG. 6, some perforations 66 are masked and closed. In other words, when the valve 70 is closed it is the perforations 72 that determine the flow area and the rate of discharge of the water through the plate 64, whereas when the valve 70 is open, as shown in broken lines in FIG. 6, it is the perforations 66 that determine the flow area and the rate of flow. Consequently, when the valve 70 is open the rate of flow is at its maximum, while when it is closed the rate of flow is at its minimum.

In order to avoid a change in the pressure of the granulation water during the operation of the valve 70 the operating conditions for the pumps conveying water through the pipe 62 into the chamber 60 has to be varied, i.e., pump output has to be increased when the valve is open and reduced when it is closed.

The valve 70 can be operated simply in the manner shown schematically in FIG. 7, by means of a system of rods 74 actuated, for example, by means of a pneumatic cylinder (not shown). The means for actuating the valve can be connected to the driving means for the pumps so that the operation of the valve automatically modifies the operating conditions of the pumps, so that the granulation pressure can be kept constant.

Figure 8:
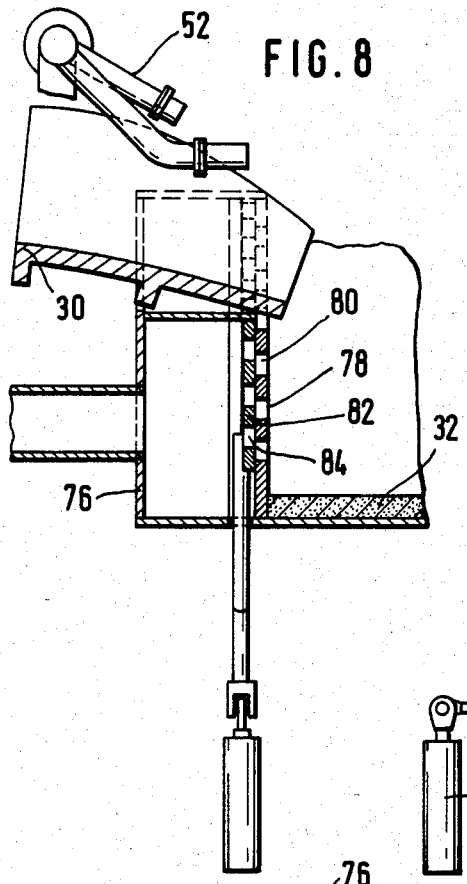
FIGS. 8 and 9 are a side elevation section and a top plan section, respectively, of a variant of the third embodiment.
Figure 10:
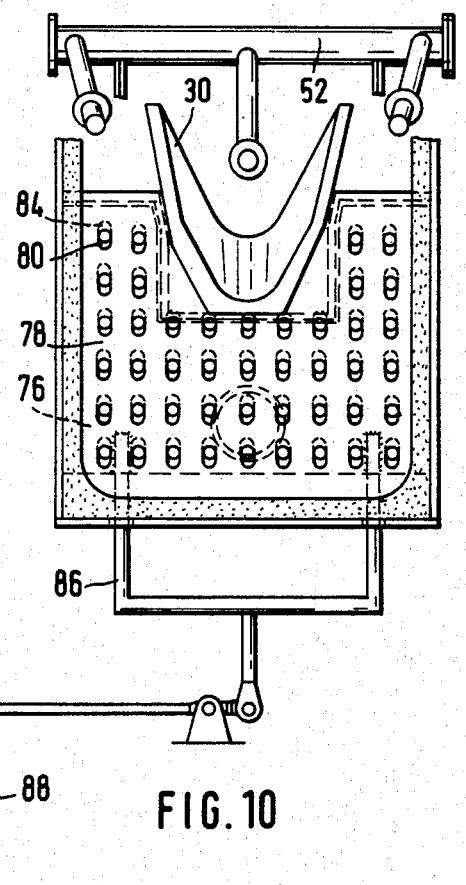
FIG. 10 is a front elevation view of the said embodiment of FIGS. 8 and 9.
Figure 9:
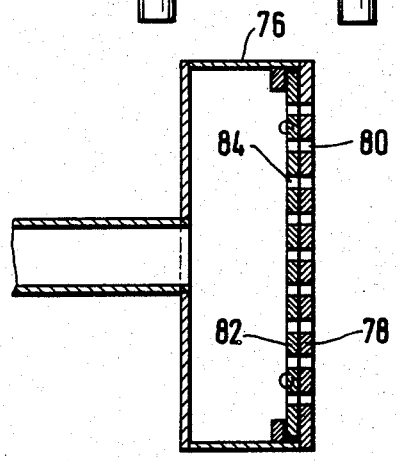

While the embodiment shown in FIGS. 6 and 7 can only operate with two particular granulation water output rates, the embodiment shown schematically in FIGS. 8–10, enables the rate of flow to be continually varied between a maximum and a minimum value. In the embodiment of FIGS. 8–10 the front wall 78 of the chamber 76 also comprises a multiplicity of perforations 80 which, as shown in FIG. 10, have an elongated shape. Inside the chamber 76 is a slide valve consisting of a plate 82 adjacent to the wall 78 and having apertures 84 corresponding to the apertures 80 and arranged in full alignment with apertures 80 when the plate 82 occupies a first (full flow) position. Plate 82 can slide vertically under the action of a system of rods 86 and an appropriate driving means such as a pneumatic jack 88. As may be seen from FIG. 10, the displacement of the valve causes the apertures 80 and 84 to overlap and communicate with each other to a greater or smaller extent, and this makes it possible for the rate of flow of the water through the front wall 78 to be varied continually. The system may be so arranged that in the open position all the apertures 80 and 84 will be completely aligned, so that the output is at its maximum, and that in the closed position the apertures 80 and 84 half cover each other in such a way that the output is reduced to 50% of the maximum. As with the FIGS. 6 and 7 embodiment, the displacement of the slide valve 82 has to be coordinated with the operating conditions of the pumps in order to ensure a constant granulation pressure.

In all embodiments, the method of the present invention operates by sensing the force required for rotation of the rotary filter drum (which is a function of the amount of molten slag being delivered to the system). This sensed parameter is then used to control the supplemental water flow in the several embodiments of the invention.

The entire contents of U.S. Pat. No. 4,204,855, U.S. patent application Ser. No. 267,800 now U.S. Pat. No. 4,374,645 and European patent application No. 0043605 are incorporated herein by reference for all that is disclosed in each.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In a process for the liquid granulation of slag wherein molten slag from a vessel is caused to drop into a granulation enclosure into which at least two currents of water are injected and from which a slurry of granulated slag and water is evacuated, the steps of:

determining the output of molten slag;

keeping the flow rate of a first of said currents constant at a rate commesurate with requirements for granulation of a first amount of molten slag; and varying the flow rate of a second current of water automatically between zero or a predetermined minimum and a higher level in accordance with changes in the output of molten slag to maintain a volume of water flow sufficient for granulation of the slag.

2. The process of claim 1 wherein:

said currents of water are arranged vertically with said second current above said first current.

3. The process of claim 1 wherein:

three currents of water are arranged in a vertical array; and the flow rate of the lowest and central currents being constant and the flow rate of the uppermost current being varied in accordance with the output of molten slag.

4. The process of claim 1 wherein:

three currents of water are arranged in a vertical array; and the flow rate of the lowest current being constant and the flow rate of the central and uppermost currents being varied in accordance with the output of molten slag.

5. The process of claims 2, 3 and 4 wherein:

the flow rate of the variable current is adjusted by an increase or decrease of a supply of ambient water; and said first current includes recycled water at 40°–90° C.

6. The process of claims 2, 3 and 4 including:

varying both the pressure and volume of the variable current.

7. The process of claims 2, 3 and 4 wherein:

the pressure of the variable current is essentially constant.

8. The process of claims 2, 3 and 4 wherein:

the variable current is on or off according to whether the output of molten slag is high or low.

9. The process of claims 2, 3 and 4 wherein:

the rate of flow of said second current is adjusted in proportion to changes in the rate of output of molten slag.

10. In apparatus for the granulation of molten slag, comprising means for the generation of a plurality of water currents under pressure and for the projection of those currents against an approximately vertically falling flow of molten slag from a channel to a spout for the evacution of slag and water, the improvement comprising:

current generating means for generating at least two of said currents of water;

means for keeping the flow rate of a first of said currents constant at a rate commensurate with requirements for granulation of a first amount of molten slag, and means for varying the flow rate of a second current of water automatically between zero or a predetermined minimum and a higher level in accordance with changes in the output of molten slag to maintain volume of water flow sufficient for granulation of the slag.

11. Apparatus according to claim 10 wherein:

said current generating means includes a plurality of water chambers;

a front wall on each of said chambers having a plurality of openings; and means for varying the rate of flow of water from at least one of said chambers.

12. Apparatus according to claim 10 wherein:

said current generating means includes chamber means connected to a source of water;

front wall means on said chamber means, said front wall means having a plurality of openings; and valve means in said chamber means for varying the flow of water through said openings in said wall means.

13. Apparatus according to claim 11 wherein:

each of said chambers is connected to a water supply pipe, with equal pressures being maintained in the chambers.

14. Apparatus according to claim 13 wherein:

said valve means includes plate means having a plurality of openings less than the openings in said wall means;

said valve means being moveable between a first position removed from said front wall means for maximum water flow and a second position against said front wall means to mask some of said front wall openings to reduce the flow of water.

15. Apparatus according to claim 13 wherein:

said valve means cooperates with said front wall means to vary the communication between openings in said wall means and openings in said valve means.

16. Apparatus according to claim 14 wherein:

said valve means is pivotally mounted in said chamber.

17. Apparatus according to claim 16 wherein:

said valve means is a slide valve positioned adjacent to and moveable relative to said front wall means.

18. The process of claim 1 wherein:

the vessel is moving vessel; and wherein the output of molten slag is determined as a function of the power required to move the vessel.

19. In a process for the liquid granulation of slag wherein molten slag from a moving vessel is caused to drop into a granulation enclosure into which currents of water are injected and from which a slurry of granulated slag and water is evacuated, the steps of:

determining the output of molten slag as a function of the power required to move the vessel; and varying the flow of at least one of said currents of water in accordance with changes in the output of molten slag.

20. The process of claim 19 wherein:

the flow rate of a first of said currents of water is kept constant at a rate commensurate with requirements for granulation of a first amount of molten slag; and the flow rate of a second of said currents of water is varied in accordance with changes in output of molten slag to maintain a volume of water flow sufficient for granulation of the slag.

21. The process of claim 20 wherein:

the flow rate of said second current of water is automatically varied between zero or a predetermined minimum and a higher level in accordance with changes in the output of molten slag.

22. The process of claim 21 wherein:

said currents of water are arranged vertically with said second current above said first current.

23. The process of claim 20 wherein:

said currents of water are arranged vertically with said second current above said first current.

24. The process of claim 19 wherein:

three currents of water are arranged in a vertical array; and;

the flow rate of the lowest and central currents being constant and the flow rate of the uppermost current being varied in accordance with the output of molten slag.

25. The process of claim 19 wherein:

three currents of water arranged in a vertical array; and the flow rate of the lowest current being constant and the flow rate of the central and uppermost currents being varied in accordance with the output of molten slag.

* * * * *